United States Patent [19]

Langley et al.

[11] Patent Number: 4,765,170

[45] Date of Patent: Aug. 23, 1988

[54] VEHICLE FRAME STRAIGHTENING MACHINE

[76] Inventors: Robert E. Langley, 1817 Mountain Ave., Santa Barbara, Calif. 93101; Roy B. Ziegler, P.O. Box 50111, Montecito, Calif. 93108

[21] Appl. No.: 794,579

[22] Filed: Nov. 4, 1985

[51] Int. Cl.[4] ..... B21D 1/12

[52] U.S. Cl. ..... 72/305; 72/705

[58] Field of Search ..... 72/705, 305

[56] References Cited

U.S. PATENT DOCUMENTS

| | | | |
|---|---|---|---|
| 3,091,278 | 5/1963 | Padgett | 72/705 |
| 3,729,978 | 5/1973 | Lunardini | 72/705 |
| 3,777,541 | 12/1973 | Whitney | 72/705 |
| 4,050,287 | 9/1977 | Borup | 72/705 |
| 4,404,838 | 9/1983 | Hare | 72/705 |
| 4,538,444 | 9/1985 | Yamada | 72/705 |
| 4,542,636 | 9/1985 | Wright | 72/705 |

FOREIGN PATENT DOCUMENTS

| | | | |
|---|---|---|---|
| 2246883 | 4/1974 | Fed. Rep. of Germany | 72/705 |
| 2606806 | 8/1977 | Fed. Rep. of Germany | 72/705 |

OTHER PUBLICATIONS

Nike Dataliner Catalogue No. 164 E, Nike Hydraulic Inc., Itasca, Ill., 60143, Sep. 1980.

*Primary Examiner*—Lowell A. Larson

*Attorney, Agent, or Firm*—Spensley Horn Jubas & Lubitz

[57] ABSTRACT

An apparatus for applying straightening forces to vehicle members. A relatively light adjustable rectangular cradle is equipped with clamps for clamping the cradle to the frame or pinch weld of a vehicle to be repaired. A transversely adjustable journal mounted on one of the beams of the cradle acts as a pivot point for a relatively long power beam which rests on the floor under the cradle and the vehicle. A hydraulically driven pivoted arm at the distal end of the power beam provides the straightening forces.

12 Claims, 4 Drawing Sheets

VEHICLE FRAME STRAIGHTENING MACHINE

BACKGROUND OF THE INVENTION

1. Field of the Invention

This invention relates to vehicular frame straightening equipment and more specifically is an apparatus for applying forces to members of vehicles for the purpose of restoring said members to their proper shape and position after an accident.

2. Description of the Prior Art

Vehicular frame straightening has up to the present involved rather bulky structures for anchoring the vehicle while applying the forces needed to correct misalignments. Usually, some elevated bridgework or similar contrivance is used to raise the vehicle off the floor so as to provide access to the vehicle structure. Separate chain anchoring means ordinarily are used as well as multiple pulling means to achieve the needed directions of pull. It is also often necessary to disconnect the vehicle from the anchors and to provide a separate system to make measurements to ascertain whether the proper alignment has been achieved.

As a consequence of the foregoing, vehicular frame straightening equipment has, up to the present, occupied an inordinate amount of shop space and has been expensive and inconvenient to use.

SUMMARY OF THE INVENTION

It is accordingly an object of the present invention to provide an apparatus for applying straightening forces to vehicle members which is substantially lighter, less bulky and less expensive than those in the prior art. This and other objects are achieved by the use of a relatively light frame cradle which can be close coupled to the vehicle structure, and a long power beam which levers on the cradle and therefore does not require heavy bearings to resist the forces applied. Multidirectional pulling forces are easily accomplished with a single pulling means using the present invention. The invention is best understood by way of the following example, including the appended drawings, which describe the presently preferred embodiment of the invention.

DETAILED DESCRIPTION OF THE INVENTION

Figure 8:
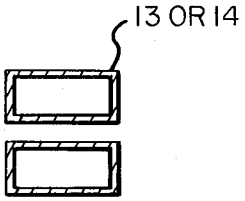
FIGS. 7 and 8 are cross sectional views of the longitudinal and transverse beam members of the frame cradle, respectively.
Figure 7:
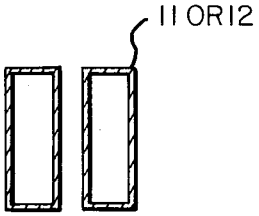
Figure 6:
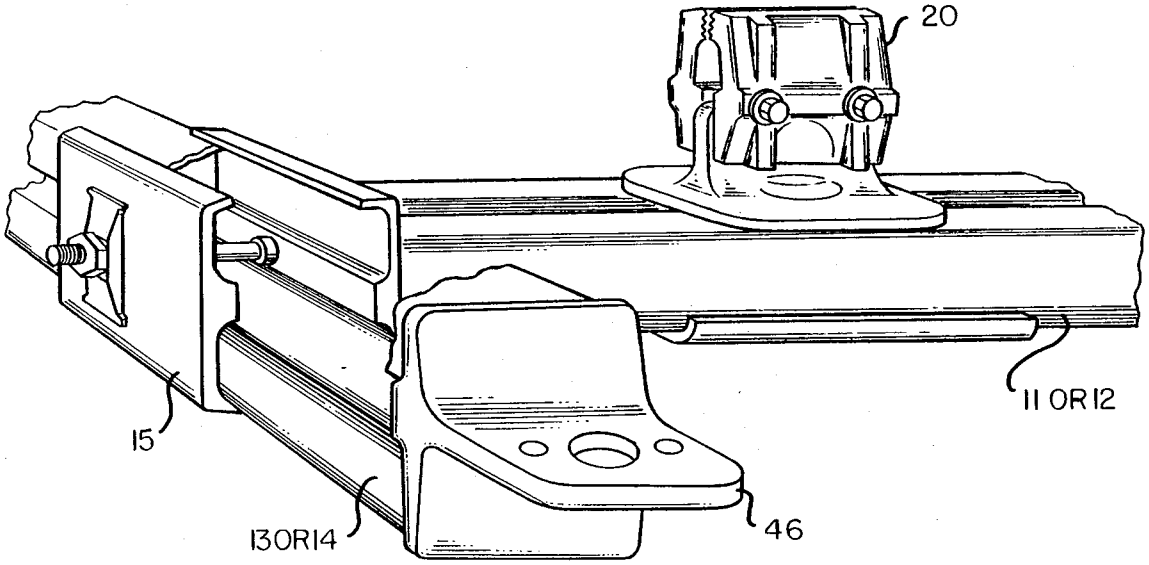
FIG. 6 is a partially cutaway perspective view of the means used to clamp the longitudual and transverse members.

The present invention uses a relatively light frame cradle clamped to the frame of a vehicle (or the pinch weld on unibody vehicles) to form a structure for coupling straightening forces to deformed vehicle members. The frame cradle is also a convenient reference structure which can be used for making measurements to determine whether the vehicle is within dimensional tolerances. These measurements can be made even while straightening forces are being applied. Frame cradle 10, which can be seen in plan view in FIG. 1, consists of a pair of longitudinal members 11 and 12 clamped at their ends to a pair of transverse members 13 and 14. Each of the members 11, 12, 13 and 14 is preferably fabricated from a pair of spaced box beams, cross sectional views of which are shown in FIGS. 7 and 8. This type of construction possesses sufficient strength to resist applied forces, and also provides a convenient slot through which clamping bolts can pass. By way of example, it may be noted that a frame cradle for general automotive work may advantageously be made using $3\times2$ inch box beams for the longitudinal members and $4\times2$ inch box beams for the transverse members. Spacing between beams in both cases is preferably about 1 inch so as to allow space to pass the bolts which secure the various clamps used.

Cradle clamps 15 at the end of each longitudinal member 11 and 12 clamp the transverse members 13, 14 to form a rectangular cradle having an adjustable width. The transverse members should be long enough so that the width can be set to accommodate the frame of any vehicle to be repaired, and in addition, they should have extra length which allows them to be positioned so as to project outside the rectangular area. Such a projective beam may be seen, for example, at 16 in FIG. 3. The purpose of having a projecting transverse beam will be discussed later. Each end of the transverse beams is provided with a chain or clevis attachment eye 46, the purpose of which will also be discussed later.

Two adjustable frame clamps 20 are mounted on each of the longitudinal members 11 and 12 and are used to secure the cradle to the vehicle structure, i.e. the frame, or the pinch weld of unibody vehicles. Straightening forces are coupled through the frame cradle and the frame clamps directly to the vehicle structure. The frame clamps may be positioned longitudinally so as to clamp the vehicle at any desired locations but in general, the clamps should be spaced as far apart as is practical under the particular circumstances. However, the particular forces to be applied may dictate that the clamps be positioned at particular points. For example, an upward lift on a doorpost would be best accomplished with one of the clamps located under the area to be raised. The frame clamps 20 swivel, allowing them to be clamped on pinch welds which are not precisely parallel to the axis of the vehicle.

Figure 4:
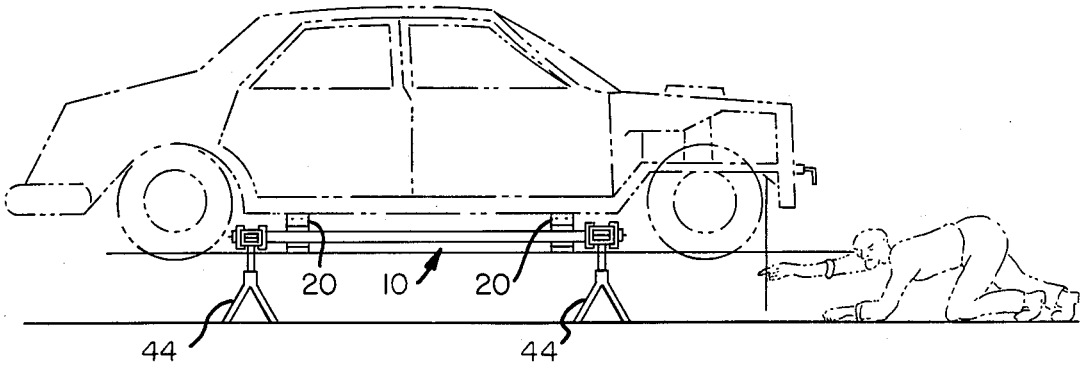
FIG. 4 is a right side view of the invented apparatus showing how line of sight measurements can be made using the frame cradle as a reference plane. For purposes of clarity, the power beam assembly is not shown.
Figure 5:
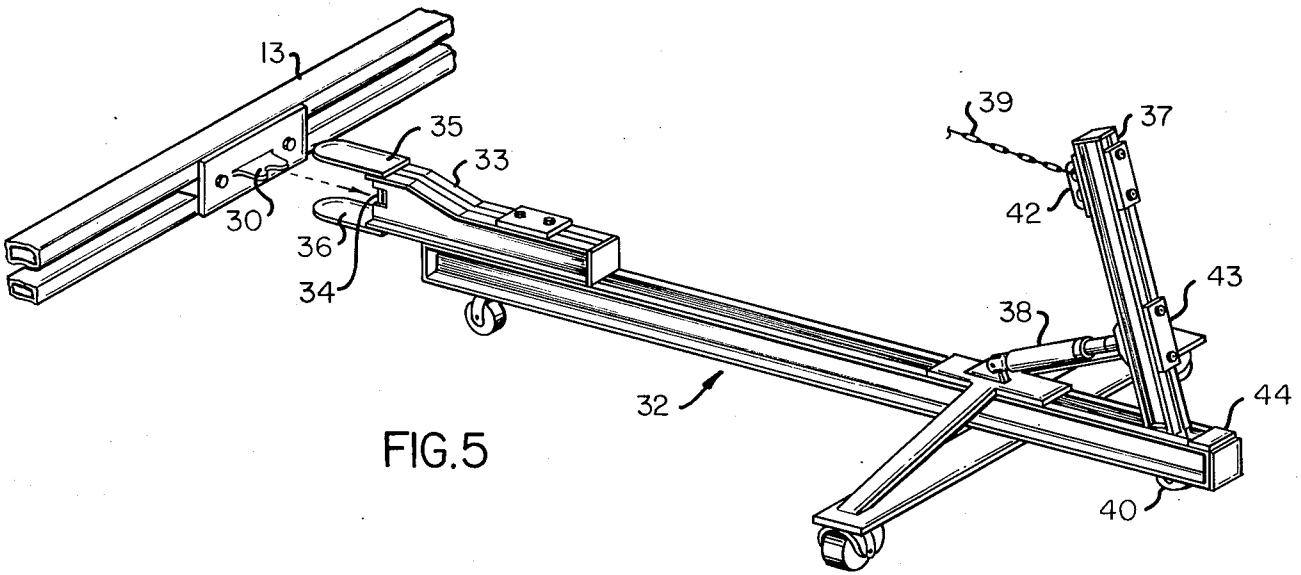
FIG. 5 is a perspective view of the power beam assembly of the invented apparatus showing how it mates with the frame cradle.

There is sufficient adjustability in the vertical clamping area of the frame or pinch weld to allow the plane of the frame cradle to be set parallel to the theoretical horizontal reference datum plane for the vehicle. This latter feature allows vertical alignment measurements to be made quickly and accurately using a steel tape and line of sight to the plane of the frame cradle as defined by the transverse members. This function is illustrated in FIG. 4 where a line of sight measurement of the height of a front frame reference point is shown. Since the frame cradle is small enough to fit between the tires of the vehicles to be repaired, the frame clamps can be quite short vertically thereby keeping the bending moments small.

Figure 1:
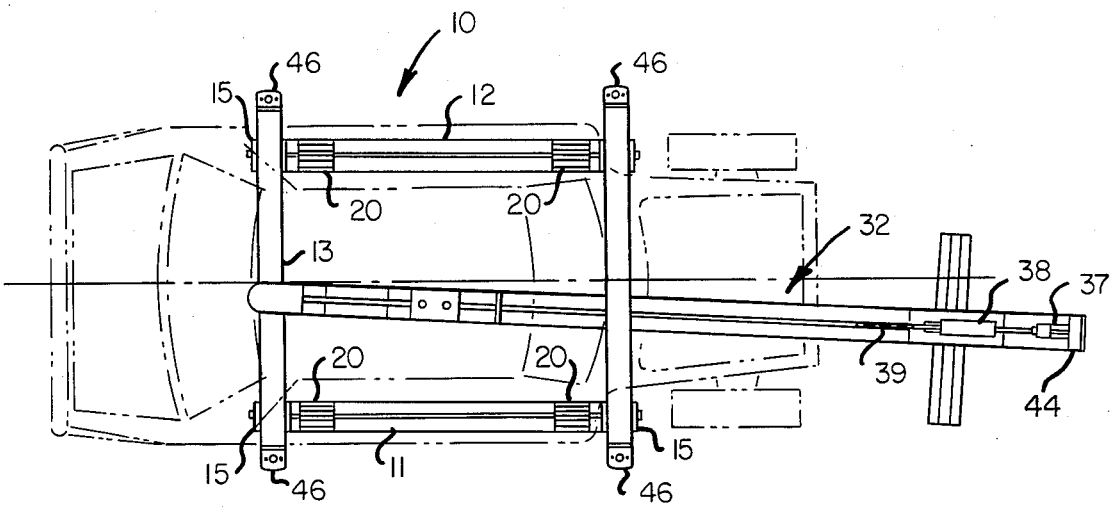
FIG. 1 is a plan view of the invented apparatus set to make a pull on a right front frame member of an automobile. The automobile is shown in phantom.
Figure 3:
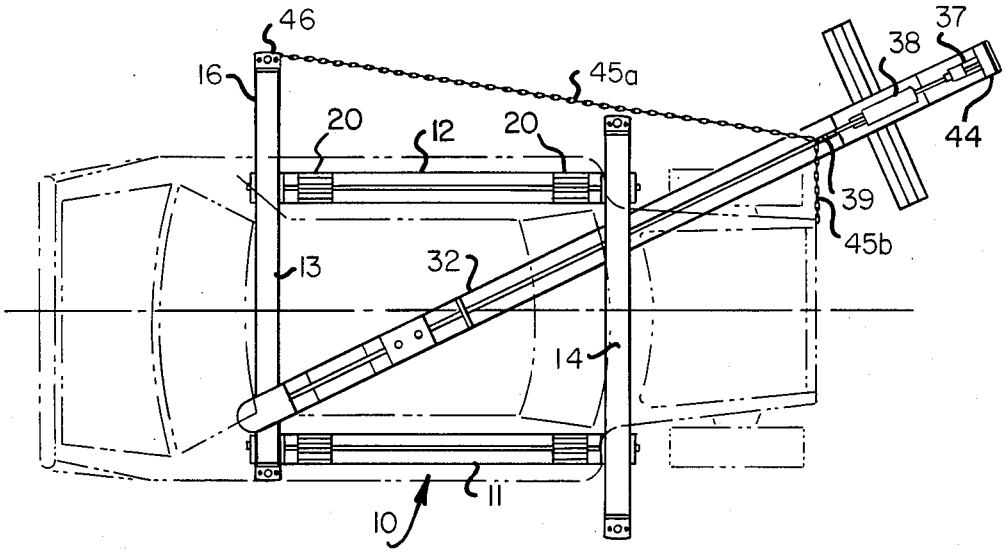
FIG. 3 is a plan view of the invented apparatus as in FIG. 1 showing how it may be set to make a pull at right angles to the axis of the vehicle.

Assuming that transverse member 13 is toward the rear of the vehicle and transverse member 14 is toward the front of the vehicle, and further that the vehicle member to be straightened is at the front of the vehicle, a pivot journal 30 is clamped to transverse member 13 at a desired transverse position. The position of pivot journal 30 on transverse member 13 will depend on the direction of pull needed to straighten the bent vehicle member as will be discussed later. FIGS. 1, and 3 show two possibilities. If the member to be straightened is at the rear of the vehicle, pivot journal 30 would be mounted to transverse member 14 instead of to 13 as shown.

Power beam assembly 32 (which includes stub beam 33) is mounted on wheels so that it can be easily moved. Pivot bar 34 at one end of stub beam 33 rides against pivot journal 30 while top and bottom plates 35 and 36 maintain the vertical positioning. The top of the beam assembly passes under transverse member 14, and the assembly is long enough to extend past the front of the vehicle being worked on. It would, of course, be possible to make a pivot journal 30 offset so as to engage the power beam below the plane of the frame cradle, thus eliminating the need for stub beam 33, but the construction as illustrated is preferred since (1) an offset journal would cause an eccentric force to be applied to member 13, and (2) the stub beam is clamped to the main beam section of power beam 32 so that the length of the beam assembly can be adjusted, if desired.

Power arm 37 is pivotally mounted at the distal end of power beam 32 and is driven by hydraulic cylinder 38. Chain 39, extending between power arm 37 and the vehicle member being straightened, applies the straightening force to the vehicle. The pivot 40 about which arm 37 rotates is preferably located below beam 32 so that a plate 44 welded across the member 32 will act as a safety stop to the motion of arm 37 in the event that there is a sudden release of the load, as when the vehicle member being straightened breaks. Chain eye 42, as well as the connection 43 between hydraulic cylinder 38 and arm 37 are both moveable along arm 37 so that the desired direction of pull and the necessary power can be realized.

Figure 2:
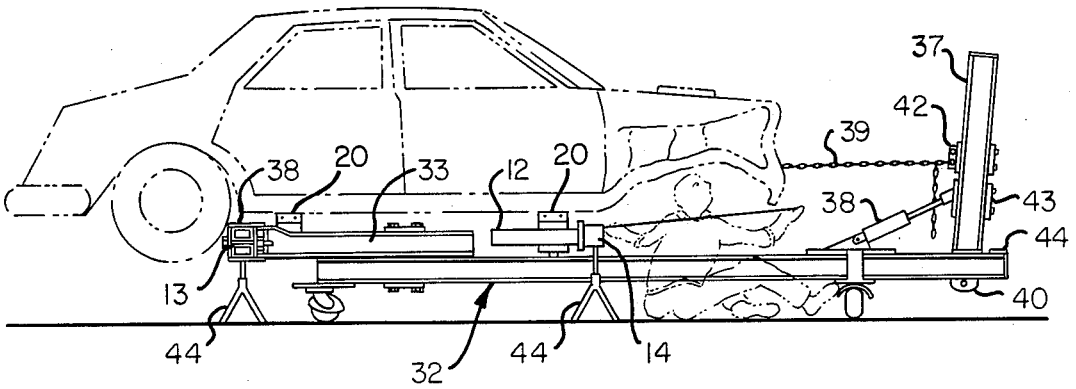
FIG. 2 is a right side view of the invented apparatus as shown in FIG. 1, partly in section.

It is a particular advantage of the present invention, as illustrated in FIGS. 2 and 4, that measurements by, e.g., steel tape can be made while the force is being applied using the frame cradle as a datum point. Such measurements can be made without change in the set up.

When chain 39 is pulling horizontally or somewhat downward, a turning moment is created tending to cause the free end of beam 32 to rise. In prior art frame straightening machines, heavy bearings or other structure must be provided to resist this moment. In the present invention, however, since beam 32 rests on the floor, and is restrained from rising by beam 14, no heavy structure is necessary for support. If the beam tends to rise, it bears against the bottom of transverse member 14, which keeps it from rising. The force of beam assembly 32 against traverse member 14 can also be used to provide an upward force at the cowl or door post, if required to correct a sagging frame.

In use, the longitudinal members 11 and 12 are first attached to the vehicle frame or pinch weld with frame clamps 20 positioned as needed for the particular straightening to be done. The transverse members 13 and 14 are then attached to the longitudinal members and cradle clamps 15 tightened. If a transverse pull is contemplated, the transverse members are positioned depending on the desired direction of pull as explained below. The plane of the frame cradle relative to the reference datum of the vehicle can then be set by adjustment of the frame clamps 20 in the vertical direction.

By raising one side of the cradle with a jack, sufficient clearance can be created to wheel power beam assembly 32 under the cradle. The cradle is then set on jack stands 44, as shown in FIG. 2, or on other suitable supports. The frames on some vehicles may be high enough so that no supports are necessary and in such cases, the vehicle can remain supported by its own wheels. If used, the jack stands are set so that member 13 is at the proper height to allow plates 35 and 36 to slip over and under the beam respectively. Member 14 is then set to be just higher than the top of member 32.

After setting pivot journal 30 to the appropriate transverse location (depending on the direction of pull desired) member 32 is pushed toward the pivot journal until pivot 34 is riding in the journal. Arm 37 is then lined up with the member to be straightened, chain 39 attached, and force applied by means of hydraulic cylinder 38. FIG. 1 illustrates a pull only slightly off parallel of the vehicle axis, while FIG. 3 illustrates a pull substantially at right angles to the vehicle axis. In FIG. 3, member 13 is shown positioned so that end 16 protrudes from the side of the vehicle. Yoke 45, comprised of sections **45*a* and 45*b* is attached to chain attachment point 46 at the end of member 13 and to the point on the vehicle to be bent. An angular pull on chain 39 as illustrated will result in a pull on chain section 45*b*** substantially at right angles to the axis of the vehicle.

Those skilled in the art will be aware of how to couple arm 37 to vehicle members and how to adjust the position of pivot journal 30 so as to achieve the desired straightening forces and it is not deemed necessary to provide further details of this aspect of the invention. It will be appreciated by those skilled in the art that the direction of pull is completely adjustable, so that pulling in multiple directions simultaneously using a single force beam can be easily accomplished.

While a presently preferred embodiment of the present invention has been disclosed above, it will be understood that various changes and modifications can be made without departing from the spirit of the invention. Consequently, the foregoing should be taken as exemplary only and the scope of the invention defined by the following claims.

We claim:

1. An apparatus for straightening vehicular frames which comprises:

(a) a pair of longitudinal beam members;

(b) a pair of transverse beam members clamped to the ends of said longitudinal members whereby a rectangular frame cradle is formed;

(c) at least two clamps for clamping to the structure of said vehicle movably attached to each of the longitudinal members of said frame cradle;

(d) a fifth beam member having one end pivotally mounted to one of said transverse beam members, the position of said pivot along said transverse beam member being adjustable, said fifth beam extending under the transverse beam member of said frame cradle opposite said pivot, said fifth beam member being free to rotate about said pivot to align itself with forces exerted;

(e) force generating means for generating a force generally parallel to said fifth beam mounted to the distal end of said fifth beam; and (f) means for coupling said force generating means to a member of said vehicle whereby a straightening force may be applied to said vehicle member.

2. The apparatus as in claim 1 where said fifth beam is supported on wheels by the floor surface under said vehicle.

3. The apparatus as recited in claim 1 wherein said beam members are each comprised of two parallel box beams spaced to allow bolts to pass therethrough.

4. The apparatus as recited in claim 1 wherein said frame clamps are each swivelable about a vertical axis.

5. The apparatus as recited in claim 1 where said fifth beam member is comprised of two portions, the first of said portions being in the plane of said frame cradle and the second of said portions being parallel to the plane of said frame cradle, but displaced therefrom.

6. The apparatus as recited in claim 1 and further including cable attaching means on at least one end of one of said transverse beam members and a first cable section extending from said cable attaching means to said force generating means and a second cable section extending approximately parallel to said transverse beam member for attachment to said member of said vehicle.

7. The apparatus as in claim 1 where said force generating means comprises:

(a) a sixth beam pivotally attached to the distal end of said fifth beam;

(b) a hydraulic cylinder attached between points on said fifth and sixth beams away from said pivot; and (c) means for coupling a cable to said sixth beam, the point of attachment of said cable being adjustable.

8. The apparatus as recited in claim 7, and further including a plate attached to said fifth beam for limiting the rotation of said sixth beam.

9. In an apparatus for straightening vehicle members, the improvement which comprises:

(a) a frame cradle for supporting a vehicle including a pair of horizontal spaced transverse beam members;

(b) at least two clamps for holding said vehicle attached to said frame cradle at longitudinally spaced points between said transverse beam members;

(c) a pivot journal attached to one of said transverse beam members;

(d) a power beam assembly, one end bearing against said pivot journal and passing adjacent to the second of said transverse beam members, said power beam assembly being free to rotate about said pivot journal to align itself with straightening forces;

(e) force generating means at the distal end of said power beam assembly; and (f) coupling means for coupling a vehicle member to said force generating means.

10. The apparatus as recited in claim 9, where the position of said pivot journal along said transverse beam is adjustable.

11. The apparatus as recited in claim 9 where said power beam assembly passes under said second transverse beam member whereby any tendency of said power beam assembly to rise when force is being generated is resisted by the second of said transverse beam members.

12. The apparatus as recited in claim 9 where said power beam assembly rests on the floor under the vehicle being repaired.

* * * * *